United States Patent [19]

Bayer

[11] 4,367,847

[45] Jan. 11, 1983

[54] ONE-PIECE MECHANICAL BREAK UP (MBU)

[75] Inventor: Christian Bayer, Armonk, N.Y.

[73] Assignee: Precision Valve Corporation, Yonkers, N.Y.

[21] Appl. No.: 220,994

[22] Filed: Dec. 29, 1980

[51] Int. Cl.[3] ..... B05B 1/34

[52] U.S. Cl. ..... 239/337; 239/469; 239/490; 239/573

[58] Field of Search ..... 239/337, 463, 466–472, 239/487, 489–497, 499, 573, 579, 589

[56] References Cited

U.S. PATENT DOCUMENTS

| | | | |
|---|---|---|---|
| 3,008,654 | 11/1961 | Abplanalp et al. | 239/468 |
| 3,085,753 | 4/1963 | Braun et al. | 239/463 X |
| 3,570,770 | 3/1971 | Ewald | 239/470 X |
| 3,635,406 | 1/1972 | Scheindel | 239/490 |
| 3,680,793 | 8/1972 | Tate et al. | 239/468 |
| 4,125,226 | 11/1978 | Nieuwkamp | 239/491 X |

FOREIGN PATENT DOCUMENTS

| | | | |
|---|---|---|---|
| 212636 | 8/1956 | Australia | 239/469 |
| 669134 | 11/1929 | France | 239/469 |
| 201608 | 7/1923 | United Kingdom | 239/468 |

*Primary Examiner*—Johnny D. Cherry

*Attorney, Agent, or Firm*—Davis, Hoxie, Faithfull & Hapgood

[57] ABSTRACT

An improved mechanical break-up actuator, molded in one piece, for spray dispensing from a pressurized aerosol dispenser has a swirl chamber with a central protruding mound and an off-center discharge orifice.

6 Claims, 5 Drawing Figures

ONE-PIECE MECHANICAL BREAK UP (MBU)

BRIEF DESCRIPTION

Apart from the below described modifications, the pressurized aerosol dispenser valve actuator of the present invention and the dies for injection molding it are generally similar to those shown in Abplanalp et al., U.S. Pat. No. 3,008,654. The principal differences are in the provision of a sloped mound or protuberance on the wall of the swirl chamber remote from the discharge orifice and the location of the discharge orifice off-center of the swirl chamber at a position on the other side of the mound from the tangential entrance passageway to the swirl chamber. These differences from 3,008,654 produce actuators which spray better and are less sensitive to die wear and to precise die alignment to result in uniform, excellent spray characteristics of actuators produced over a long runs of the molding equipment.

BACKGROUND

To improve the spraying characteristics of pressurized aerosol dispensers, various nozzle design ideas have been employed. Valve actuators or buttons have been provided with a swirl chamber having a tangential entrance to cause a spin of the product stream before it issues from the discharge orifice. That spin causes the stream to break into relatively small droplets in response to centrifugal force as the product stream issues from the discharge orifice. This mechanical break-up of the product stream provides an excellent spray pattern in terms of evenness of droplet distribution and of droplet size. Abplanalp et al., U.S. Pat. Nos. 2,989,251, 3,008,354, 3,083,917, and 3,083,918 show various mechanical break-up buttons and the dies for injection molding them.

Actuators according to the present invention produce spray characteristics superior to prior mechanical break-up actuators. Further, it has been found that the need to make adjustments to the dies to produce actuators having uniform excellent spray patterns can be reduced by incorporating the modifications which are the subject of the present invention. The resulting actuators are more uniform in their spray characteristics over a long molding run on a set of dies.

THE DRAWINGS

FIG. 1 is a cross-section through a valve actuating button according to the invention, FIG. 2 is a front view of the button, FIG. 3 is a partial view in cross-section taken along line III—III of FIG. 1, FIG. 4 is a view in cross-section of the dies used to mold the button, and FIG. 5 is a perspective view of a portion of a core pin of the dies used to mold the button.

DESCRIPTION OF A PREFERRED EMBODIMENT

Figure 1:
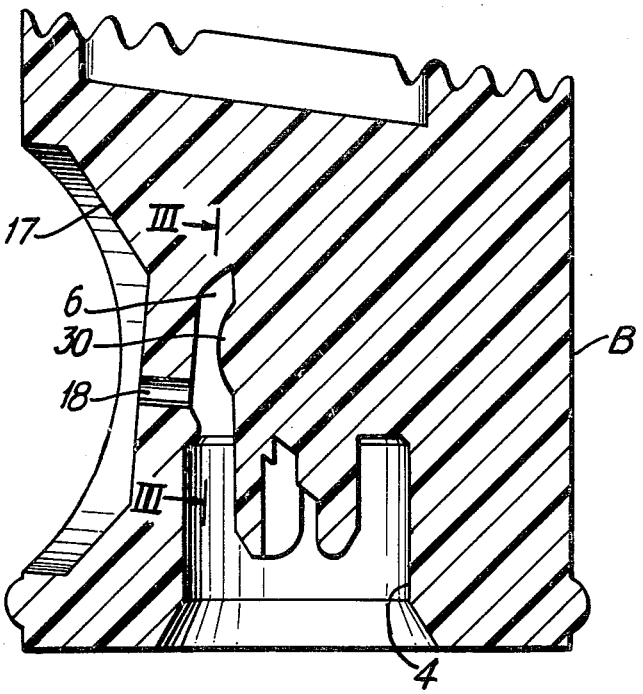
Figure 2:
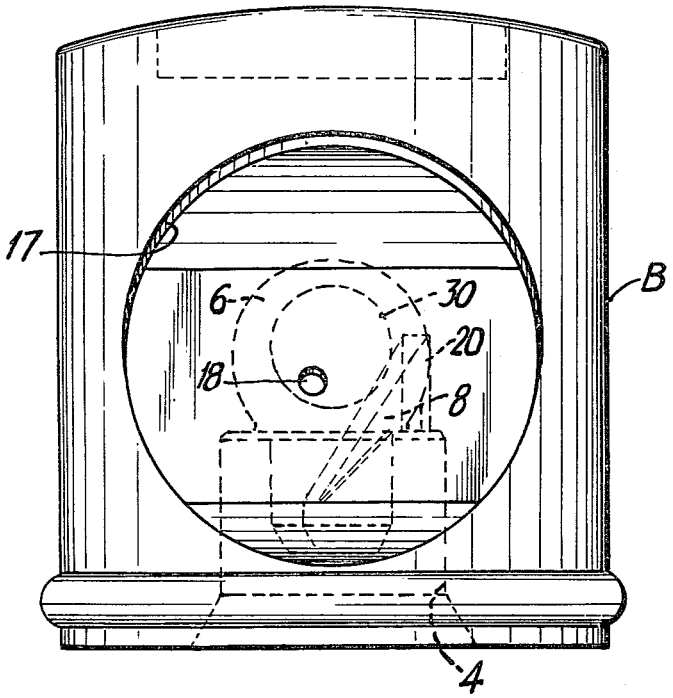
Figure 3:
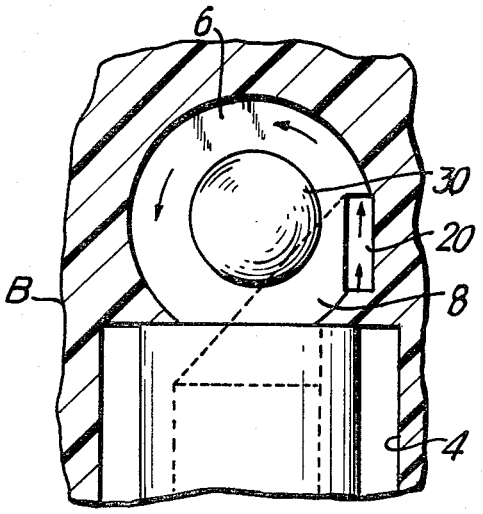
Figure 4:
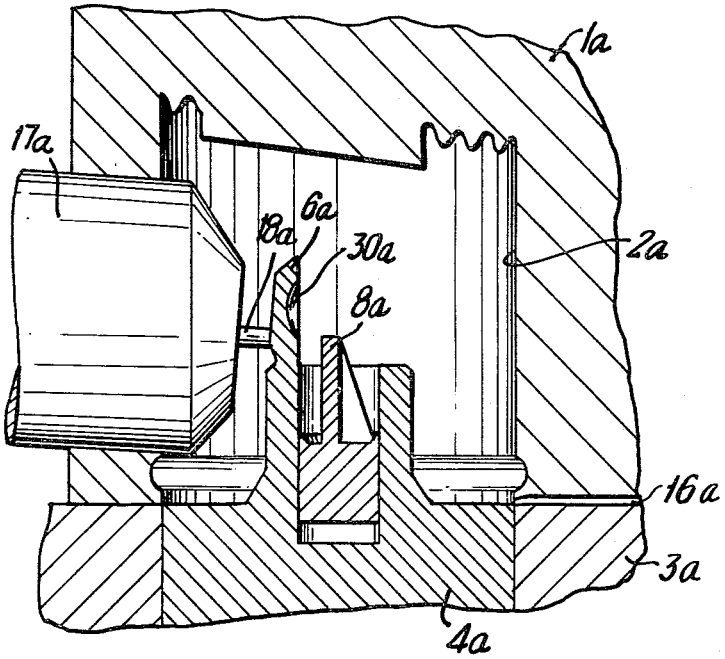
Figure 5:
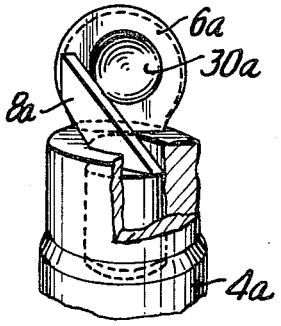

FIGS. 1–3 illustrate a one-piece integral valve actuating mechanical break-up button of the present invention and FIGS. 4 and 5 illustrate the dies for molding it. The button B is intended to fit on the upstanding hollow valve stem of the valve of a pressurized dispenser. The button B shown in FIGS. 1–3 is a one-piece injection molding of a suitable polymer such as a polyolefin. The button has a discharge orifice 18 within a circular depression 17 in the front of the exterior surface of the button. A valve stem receiving socket 4 is adapted to engage frictionally the upper end of a hollow valve stem on a pressurized dispenser. Alternatively, the valve stem can be integral with the actuator and the socket for its receipt can be part of the valve. Internally of the button is a passage 8 leading from the valve stem receiving socket 4 to a swirl chamber 6. Within the swirl chamber 6 is an entrance 20 at the end of passage 8 and a spherical mound 30 which aids in imparting a swirling motion to the product. The discharge orifice 18 is off-center of, and in communication with the swirl chamber 6. Although the present invention is described and illustrated in the form of a valve actuator button, the invention is applicable to other forms of valve actuators such as a cap-style of actuator shown, for example, in Abplanalp U.S. Pat. No. 3,269,614.

Depression of the button opens the valve of the dispenser and allows product under pressure to flow from the valve discharge passage or valve stem to passages within the button to issue from the discharge orifice 18 of the button as a spray of small uniform droplets. A variety of products such as paints, insecticides, hair sprays, and various housekeeping products are dispensed from pressurized aerosol dispensers in this general fashion.

Referring to FIGS. 1, 2 and, particularly FIG. 3, the pressurized product is conducted from the valve stem receiving socket via sloping passageway 8 to an entrance aperture 20 on the right side (as seen in FIG. 3) at a position corresponding to about 4 o'clock of a swirl chamber 6. Entrance aperture 20 introduces the product tangentially of swirl chamber 6 to cause the product to travel circularly about the central axis of the generally circular swirl chamber. A generally spherical mound 30 is located centrally of and on the rear wall of the swirl chamber 6 and serves to encourage circular flow about the swirl chamber 6. The product travels about the swirl chamber 6, about two thirds of the way around the mound 30 and issues from a discharge orifice 18 which extends from the generally planar front wall of the swirl chamber. The discharge orifice is displaced from the central axis of the swirl chamber in a direction away from the entrance 20. It has been found that a location at a position overlying the slope of the mound and on an imaginary line at approximately 7 o'clock when viewed from the front is satisfactory. In the prior mechanical break-up buttons, the rear wall of the swirl chamber was generally planar.

Because of its circular travel about the swirl chamber 6, the product stream issuing from the discharge orifice is in rapid rotation. Centrifugal force due to that rotation causes the emerging product stream to break into small droplets which move radially due to the centrifugal force and longitudinally due to the velocity of the emerging stream to result in a conical fan of small droplets.

In the prior mechanical break-up buttons, precise coaxial alignment of the discharge orifice with the circular swirl chamber was required for good spray characteristics. Deviation from coaxial alignment resulted in an irregular spray pattern. The present combination of a mound 30 and a location of the discharge orifice 18 over the sloping side of the mound 30 remote from the entrance 20 accommodates variations in die alignment precision without a deleterious effect upon the spray characteristics.

The mound 30 is an execution of the invention is 0.090 inches in diameter, 0.014 inches high, and has a radius of spherical curvature of 0.062 inches. These dimensions result in a mound approximately half the diameter of the swirl chamber. Mound shapes other than spherical may be employed and off-center discharge orifice locations other than that shown are possible. It is not the specific mound shape or size, but the cooperation of the mound and off-center orifice which results in the more consistent spray performance.

Referring now to FIGS. 4 and 5, the dies for injection molding the button of the present invention are shown. A die 1*a* having a cavity 2*a* cooperates with die 3*a* to form the exterior surface of the button. A core pin 4*a* forms the valve stem receiving socket 4 of the button. Core pin 4*a* also includes member 8*a* which forms the sloping passage 8 and a member 6*a* which forms the swirl chamber 6. A depression 30*a* of generally spherical shape in the rear face of member 6*a* forms the mound 30. A further core pin 17*a* forms the circular depression 17 in the front of the button. An extension 18*a* of core pin 17*a* meets swirl chamber portion 6*a* of core pin 4*a* to form the discharge orifice 18. Polymer is injected under high pressure through mold passage 16*a* into the resulting die cavity. After the polymer cools to a solid, the core pins 4*a* and 17*a* are withdrawn and the completed button is ejected from the die. The cooled polymer is sufficiently flexible to accommodate removal of the button from the undercuts of the dies.

The button of the present invention requires no change in the pressurized dispenser valve to allow substitution of it for buttons lacking the features of the present invention. The dimensions of the orifice 18, swirl chamber 6 and valve stem receiving socket 4 may be altered to suit particular product formulations and particular valve stems.

I claim:

1. In a one-piece integral molded valve actuator for a pressurized aerosol dispenser, said actuator having means to mount the actuator on the valve of the dispenser in communication with the product discharge passage of the valve, a generally circular swirl chamber molded within the actuator, a passage molded within the actuator in communication with the valve discharge passage and extending to an entrance aperture of the swirl chamber, the entrance aperture being located to introduce product circumferentially of the swirl chamber, the swirl chamber having a front wall with a discharge orifice extending from the front wall of the swirl chamber to the front exterior of the actuator, and a rear wall normal to the central axis of the swirl chamber, the improvement which comprises a sloped mound on the rear wall protruding into the swirl chamber centrally thereof, and the discharge orifice being located off-center of the swirl chamber axis and remote from the entrance aperture.

2. The actuator of claim 1 wherein the mound is generally hemispherical in shape.

3. The actuator of claim 1 wherein the discharge orifice is located about two thirds of the way around the mound from the entrance aperture.

4. The actuator of claim 1 wherein the diameter of the mound is approximately one-half that of the swirl chamber.

5. The actuator of claim 1 wherein the entrance aperture is located at a position corresponding to approximately 4 o'clock and the discharge orifice is located at a position corresponding to approximately 7 o'clock when the actuator is viewed from the front.

6. The actuator of claim 1 wherein the discharge orifice overlies the sloped side of the mound remote from the entrance aperture.

* * * * *